US005725211A

United States Patent [19]

Blanchard et al.

[11] Patent Number: 5,725,211

[45] Date of Patent: Mar. 10, 1998

[54] METHOD AND APPARATUS FOR REGISTERING IMAGES ON THE FRONT AND THE BACK OF A SINGLE SHEET OF PAPER

[75] Inventors: Kenneth F. Blanchard, Walworth; Richard C. Schenk, Webster, both of N.Y.

[73] Assignee: Xerox Corporation, Stamford, Conn.

[21] Appl. No.: 520,148

[22] Filed: Aug. 28, 1995

[51] Int. Cl.[6] ..... B65H 7/02

[52] U.S. Cl. ..... 271/265.02; 271/265.01

[58] Field of Search ..... 271/65, 291, 265.02, 271/259, 270, 265.01

[56] References Cited

U.S. PATENT DOCUMENTS

| | | | |
|---|---|---|---|
| 3,947,016 | 3/1976 | Horung et al. | 271/265.02 |
| 4,416,534 | 11/1983 | Kluger | 355/145 H |
| 4,445,679 | 5/1984 | Bay | 271/265.02 |
| 4,453,841 | 6/1984 | Bobick et al. | 400/126 |
| 4,475,156 | 10/1984 | Federico et al. | 363/300 |
| 4,519,700 | 5/1985 | Barker et al. | 355/35 H |
| 4,540,170 | 9/1985 | Masuda et al. | 271/265.02 |
| 4,589,765 | 5/1986 | Perun et al. | 271/265.02 |
| 4,591,145 | 5/1986 | Cherian | 271/258 |
| 4,918,490 | 4/1990 | Stemmle | 271/301 |
| 4,934,681 | 6/1990 | Holmes et al. | 271/3 |
| 4,935,786 | 6/1990 | Veeder | 355/319 |
| 4,971,304 | 11/1990 | Lofthus | 271/227 |
| 5,078,384 | 1/1992 | Moore | 271/228 |
| 5,094,442 | 3/1992 | Kamprath et al. | 271/227 |
| 5,110,113 | 5/1992 | Kanaya | 271/241 |
| 5,156,391 | 10/1992 | Roller | 271/227 |
| 5,169,140 | 12/1992 | Wenthe, Jr. | 271/228 |
| 5,172,907 | 12/1992 | Kalisiak | 271/227 |
| 5,278,624 | 1/1994 | Kamprath et al. | 355/317 |
| 5,328,168 | 7/1994 | Fox | 271/259 |
| 5,337,135 | 8/1994 | Malachowski et al. | 355/319 |
| 5,516,094 | 5/1996 | Sander | 271/259 |
| 5,540,370 | 7/1996 | Ring | 271/270 |
| 5,555,084 | 9/1996 | Vetromile et al. | 355/317 |
| 5,562,195 | 10/1996 | Isaacs | 271/270 |
| 5,596,399 | 1/1997 | Dempsey et al. | 271/265.02 |

FOREIGN PATENT DOCUMENTS

| | | |
|---|---|---|
| 0374575A2 | 6/1990 | European Pat. Off. . |
| 4024464A1 | 2/1991 | Germany . |

*Primary Examiner*—William E. Terrell
*Assistant Examiner*—Khoi H. Tran
*Attorney, Agent, or Firm*—H. Fleischer; J. E. Beck; R. Zibelli

[57] ABSTRACT

A sensing and a control system are disclosed for eliminating registration error during duplex printing in a multi-pass xerographic printing system. The system registers a common physical edge of a sheet using multiple pairs of sensors. During the first pass or simplex pass, a first set of sensors detect the leading edge of a sheet of paper, and during the second pass or duplex pass, a second set of sensors detect the trailing edge of a sheet of paper. The control system regulates the rate at which a sheet should be driven to be in timed registration with a developed image on a photoreceptor at a transfer station. Variations in sheet size due to sheet cut tolerances are eliminated by the sensing and the control system since any offset is directed towards a common physical edge when developed front and back images on a photoreceptor are registered with a sheet of paper.

15 Claims, 7 Drawing Sheets

METHOD AND APPARATUS FOR REGISTERING IMAGES ON THE FRONT AND THE BACK OF A SINGLE SHEET OF PAPER

The present invention relates to a method and apparatus for duplex printing, and in particular for registering a first image on the front side of a duplex sheet of paper with a second image on the back side of the duplex sheet of paper.

BACKGROUND OF THE INVENTION

Duplex printing which marks both sides of a sheet of paper or the like can be performed using a multi-pass printing system. Multi-pass duplex printing refers to a printing system that marks both sides of a sheet of paper using a single transfer station. After a sheet has received a front image after a first pass through an image transfer station, the sheet of paper, after being inverted, receives a back image after a second pass through the transfer station. The 5090 printer and the DocuTech® Production Publisher, both of which are products of the Xerox® Corporation, are examples of systems that perform duplex printing using two passes through a single imaging station.

Registration of the front image with the back image on a single sheet of paper using a multi-pass systems is not always accurate because of registration error that offsets the front image from the back image. For example, a border surrounding every page in a document should be aligned on the front and the back of every sheet. Offset from the boarder on the back side of a sheet with respect to the boarder on the front side of a sheet is registration error that is not acceptable in the offset printing industry when printing images on both sides of a sheet of paper.

Active registration systems which sense document position and operate to correct the position of a copy sheet, if necessary, before an image is transferred thereto are well known. For example, U.S. Pat. No. 4,971,304 to Loftus discloses an apparatus for deskewing and side registering a copy sheet. The apparatus includes copy sheet drivers that are independently controllable to selectively provide differential and non-differential driving of the copy sheet in accordance with the position of the copy sheet as sensed by at least three sensors. In addition, Loftus discloses a fourth sensor to measure the position of the sheet after deskew and side-registration with respect to the position of a latent image on a photoreceptor with respect to a transfer station. Similar deskewing and side registration systems have been disclosed in U.S. Pat. Nos. 5,169,140; 5,156,391; 5,094,442; 5,078,384; 5,172,907; and 5,278,624. Other registration systems which are mechanical in nature deskew and side register by urging a copy sheet against a guide or gate. Examples of mechanical registration systems are disclosed in U.S. Pat. Nos. 4,416,534; and 4,519,700.

Registering two images on the front and back sides of a single sheet of paper is not only difficult but is necessary in order for the offset printing industry to produce duplex sheets having a number of pages aligned on the front and back of a single sheet of paper. Generally in the offset printing industry, a sheet of paper printed with multiple images on the front and back side of a single composite sheet. The single composite sheet is subsequently folded and segmented into individual pages. Each image on the front of the sheet must therefore be registered with a corresponding image on the back of the sheet before the sheet may be segmented into individual pages. Specifically, a first image that appears on the front side (or simplex side) of a sheet and a second image that appears on the back side (or duplex side) of the sheet are positioned so that identical images printed on both sides of the sheet would be coincident with each other. In other words, two identical images printed on both sides of a sheet of paper form mirror images of each other since each image is printed with no apparent offset from the other. Thus, an image on the front side of a sheet would appear to be in perfect or transparent registration with the corresponding image on the back side of the sheet.

The offset printing industry uses a two step process that is external to a printing system to insure that a plurality of front and back images are properly registered on a composite sheet of paper. First, a front image on a set of copy sheets is imaged. Second, before printing a back image, the set of copy sheets is positioned on its back side so that the lead edge of each copy sheet is the same as the front sheets. To print copy sheets in this manner requires that an image or a plate be inverted from its front side orientation before it can be imaged onto a copy sheet. This manner of printing duplex sheets insures that the printing system will propagate registration error towards the same edge of a sheet of paper.

The multi-pass duplex registration system with a single imaging station used in the 5090 and the DocuTech® Production Publisher printing systems is not as precise as the offset industry because the multi-pass registration system uses a single edge to register both the front and back images. Typically, the single edge is the lead edge which allows registration error to develop because of variations in sheet sizes. Sheet sizes tend to vary because of existing sheet cut tolerance levels. For example, a sheet may vary up to ±2 mm from a specified size. Because duplex printing systems use the same edge regardless of the plex of a sheet (i.e. front or back) sheet cut tolerance will translate into registration error when printing a two sided document. The present invention overcomes this problem of registering two images printed on a front and a back of a single sheet using a multi-pass duplex printing system as described below.

SUMMARY OF THE INVENTION

In accordance with one aspect of the invention, there is provided an apparatus for registering a first image printed on a first side of a sheet and a second image printed on a second side of the sheet with one another at a transfer station. A transport moves the sheet to the transfer station. A first sensor detects a first edge of the sheet before printing the first image on the first side of the sheet. A second sensor for detecting the first edge of the sheet after printing the first image on the first side of the sheet and before printing the second image on the second side of the sheet. The sheet is inverted after printing the first image on the first side of the sheet so that the first edge is the leading edge of the sheet in the direction of movement of the sheet before inverting the sheet and the trailing edge of the sheet after inverting the sheet. A controller, responsive to the sensor, regulates the transport so as to position the sheet at the transfer station to print the first image on the first side of the sheet and the second image on the second side of the sheet in registration with one another.

In accordance with another aspect of the invention, there is provided a method for registering a first image printed on a first side of a sheet and a second image printed on a second side of the sheet with one another at a transfer station. The method includes the steps of moving the sheet along a transport to the transfer station; detecting a first edge of the sheet with a first sensor before printing the first image on the first side of the sheet; detecting the first edge of the sheet with a second sensor after printing the first image on the first side of the sheet and before printing the second image on the second side of the sheet with the sheet being inverted after printing the first image on the first side of the sheet so that the first page is the leading edge of the sheet in the direction of movement of the sheet before inverting in the sheet and the trailing edge of the sheet after inverting the sheet; and regulating the transport with a controller so as to position the sheet at the transfer station to print the first image on the first side of the sheet and the second image on the second side of the sheet in registration with one another.

BRIEF DESCRIPTION OF THE DRAWINGS

These and other aspects of the invention will become apparent from the following descriptions to illustrate a preferred embodiment of the invention read in conjunction with the accompanying drawings wherein the same reference numerals have been applied to like parts and in which.

DETAILED DESCRIPTION

Figure 1:
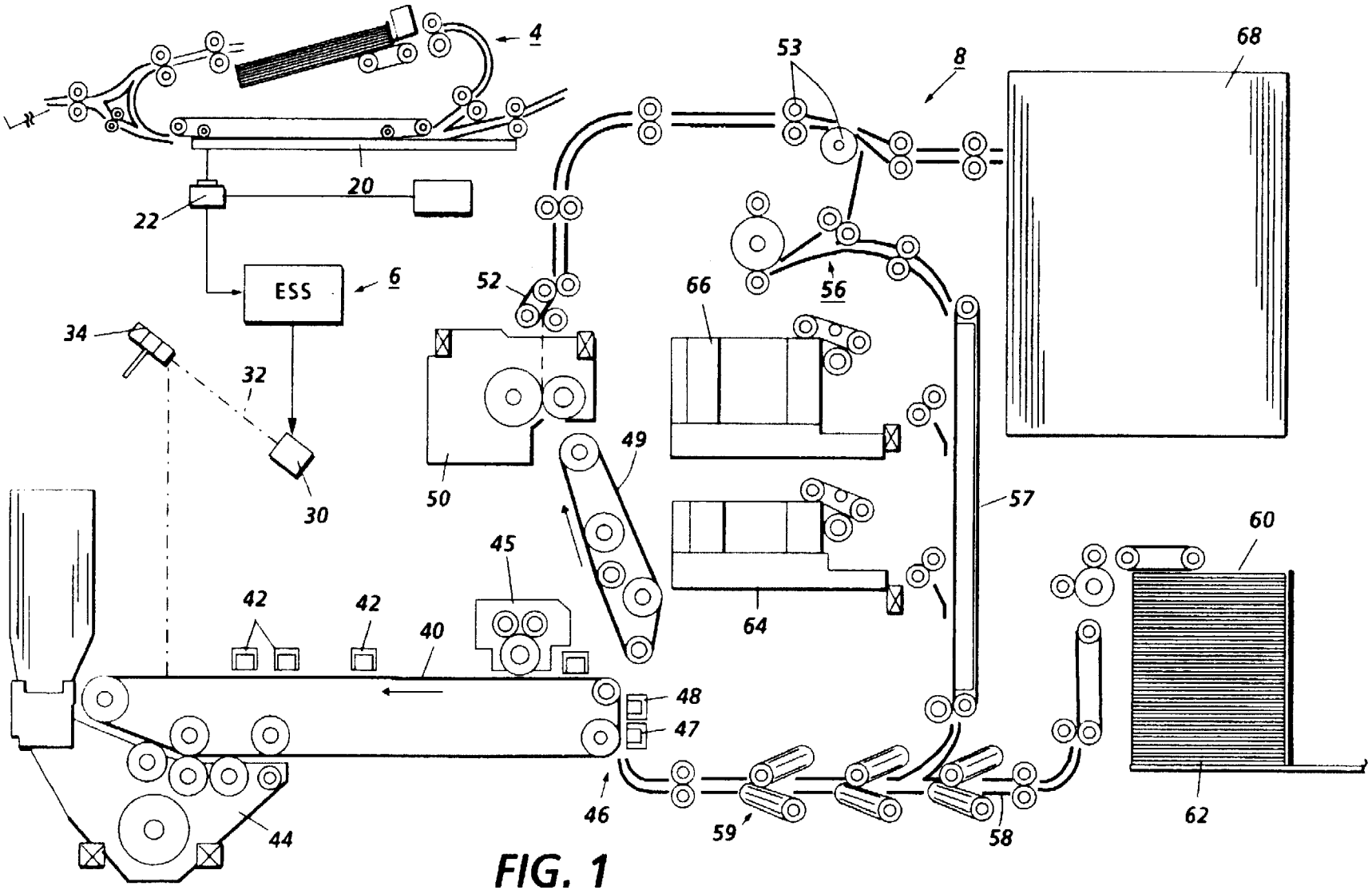
FIG. 1 is a schematic elevational view depicting an illustrative electrophotographic printing machine incorporating the present invention.

Referring now to the drawings where the showings are for the purpose of describing the preferred embodiment of the invention and not for limiting same, there is shown in FIG. 1 an exemplary printing system or imaging device for processing a print job in accordance with the teachings of the present invention. Generally, the printing system consists of a scanner section 4, a controller section 6, and a printer section 8. Scanner section 4 includes a transparent platen 20 on which a document to be scanned is located. One or more linear arrays 22 are supported for reciprocating scanning movement below platen 20. Array 22 provides image signals or pixels representative of the image scanned which, after suitable processing, are output to controller section 6. Image signals output by array 22 are converted to digital image signals and processed as required to enable controller section 6 to store and handle image data in the form required to reproduce a document as programmed in controller 6. The control section 6, also known as an electronic subsystem (ESS), includes control electronics which prepare and manage flow of image data between scanner 4 and printer 8. ESS 6 may also include a user interface to program a print job and a memory for storage of image data. Printer section 8 comprises a laser type printer. While a specific printing system is shown and described, the present invention may be used with other types of printing systems such as ink jet, ionographic, etc.

Generally, the control of all machine functions, including all sheet feeding, is maintained by ESS 6. Preferably, ESS 6 is a programmable microprocessor system, as exemplified by U.S. Pat. No. 4,475,156 and its references, which conventionally controls all the machine steps and functions described herein, and others, including the operation of document feeders, all the document and copy sheet deflectors or gates, sheet feeder drives, downstream finishing devices etc. As further taught in the references, the ESS 6 also conventionally provides for storage and comparison of the counts of copy sheets, number of documents recalculated in a document set, desired number of copy sets and other selections and controls by an operator through a console or other panel of switches connected to the ESS 6, etc. The ESS 6 is also programmed for time delays, jam correction, etc. Conventional path sensors or switches may be utilized to help keep track of the position of the documents and the copy sheets and the moving components of printer 8 by connections to the ESS 6. In addition, the ESS 6 variably regulates the various positions of the gates depending upon which mode of operation is selected.

After a digital representation of an image of a print job is scanned and stored in ESS 6, Raster Output Scanner (ROS) 30 creates latent electrostatic images on photoreceptor 40. ROS 30 has a laser, the beam of which is split into two imaging beams 32. Beams 32 are scanned across a moving photoreceptor 40 by the mirrored facets of a rotating polygon 34 to expose two image lines on photoreceptor 40 with each scan thereby creating the latent electrostatic images represented by the image signal input to ROS 30 from ESS 6. Initially, before exposure to imaging beams 32, photoreceptor 40 is uniformly charged by corotrons 42 at a charging station. The latent electrostatic images are developed by developer 44 which forms a toner image on photoreceptor 40. The toner images are transferred at transfer station 46 to sheets of paper delivered by one of three paper supplies. Three paper supplies, main paper supply 62, or auxiliary paper supplies 64, or 66, may comprise any of a variety of sheet sizes, types, and colors. Residual toner particles that remain on photoreceptor belt 40 after a toner image passes through transfer station 46 are removed by cleaning station 45.

More specifically, registration of a toner image with a sheet occurs when registration transport 59 brings a sheet forward in timed registration with a developed image on photoreceptor 40 at transfer station 46. Initially, registration transport 59 receives a sheet from either vertical transport 57 or main paper transport 58, which are fed sheets from auxiliary paper trays 64 and 66 or from main paper tray 62, respectively. Once side-to-side registered along registration transport 59, a sheet (such as sheet 60 for example) is then moved into contact with a first toner image output from developer 44. Next, a corona generating device 47 charges the sheet to the proper magnitude and polarity as the sheet is passed through photoconductive belt 40. The first toner image is attracted from photoconductive belt 40 to the sheet. After transfer, a corona generator 48 charges the sheet to the opposite polarity to detack the sheet from the belt 413. Conveyor 49 then advances the sheet to fusing station 513. The developed image transferred to the sheet is permanently fixed or fused by fuser 50. After fusing, the sheet is fed through a decurler 52. Decurler 52 bends the sheet in a first direction and puts a known curl in the sheet, and then bends it in the opposite direction to remove that curl. Forwarding rollers 53 advance the sheet to an output tray 68 or a duplex inverter 56. A sheet inverted by duplex inverter 56 travels from vertical transport 57 to registration transport 59 for registration with a second toner image on photoreceptor 40. After registration on transport 59, the second toner image is transferred to the sheet at transfer station 46.

Figure 2:
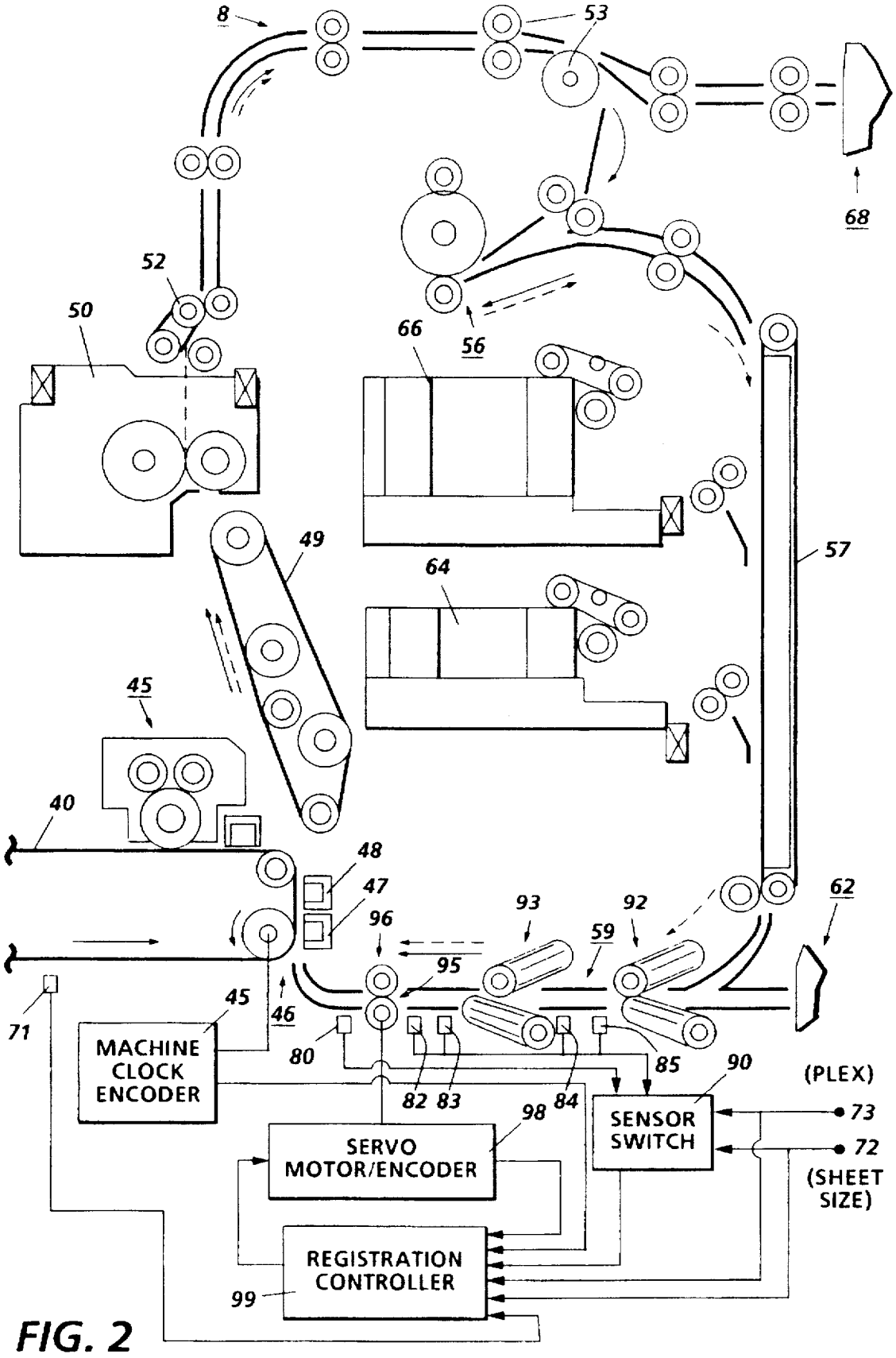
FIG. 2 is an enlarged schematic elevational view of a duplex sheet path used in the FIG. 1 printing machine.

FIG. 2 is a detailed schematic view of the duplex and simplex paper paths through which sheets are conveyed in the printer 8 shown in FIG. 1. In FIG. 2, the path through which a sheet travels during simplex imaging is illustrated by the arrowed solid lines, whereas the path through which a sheet to be duplex imaged travels is illustrated by the arrowed broken lines. After a sheet is supplied from one of feed trays 62, 64, or 66, the sheet is conveyed past image transfer station 46 to receive a first image as previously described. The sheet then passes through fuser 50 where the image is permanently fixed or fused to the sheet. After passing through rollers 53, gates (not shown) either allow the sheet to be discharged to output tray 68, or deflected into single sheet inverter 56. If the sheet is either a simplex sheet or a duplex sheet having completed side one and side two images formed thereon, the sheet is conveyed directly to output tray 68. Output tray 68 may be a high speed finisher which includes a stitcher and a thermal binder. If the sheet is a duplex sheet printed only with a side one image, a gate (not shown) deflects the sheet into inverter 56, where the sheet is inverted and then fed to vertical transport 57. Subsequently, the sheet is fed to registration transport 59 for recirculation past transfer station 46 and fuser 50 for receiving and permanently fixing the side two image to the backside of the sheet.

A sheet receives an image on its front side and back side after two passes through transfer station 46 and fuser 50. The duplex paper feed path shown in FIGS. 1 and 2 includes a single sheet inverter 56 that inverts a sheet after it has made a first pass through transfer station 46 and fuser 50. Examples of single sheet inverters are disclosed in U.S. Pat. Nos. 4,918,490; 4,935,786; 4,934,681; and 4,453,841, the disclosures of which are herein incorporated by reference In an alternate embodiment, the duplex paper feed path could consist of a buffer tray instead of the single sheet inverter 56. The single sheet inverter and duplex paper path employed in the present embodiment is capable of handling sheets ranging in width from 8 to 17 inches and ranging in length from 10 to 14.33 inches.

As defined herein, the "width" of a sheet (or a copy sheet width) for purposes of the copy sheet paper path is the length of the edge of the sheet which is parallel to a process direction in which copy sheets are fed through the paper path. In the present embodiment, since smaller sheets such as 8½×11 inches sheets are fed with their long edge (the 11 inch edge) first, their "width" in the paper path is 8½ inches. Since large sheets such as 11×17 inch sheets are fed with their short edge (the 11 inch edge) first, their width in the paper path is 17 inches. Also, the "lead" edge of a copy sheet travels through the paper path in the process direction. Conversely, the "length" of a copy sheet is the edge of a sheet that is perpendicular to the sheet's process direction. In a system with a duplex paper path, such as the system described herein, the "lead" edge of a copy sheet which travels perpendicular to the process direction becomes the "trail" edge of the copy sheet once the sheet is inverted by duplex inverter 56.

For example, on a first or simplex pass, a sheet initially fed from auxiliary paper supply 64 travels along vertical transport 57 and then onto registration transport 59. Registration rollers 92 and 93 are connected together and driven by a servo motor (not shown). Nips of registration rollers 92 and 93 are independently released by individually mounted solenoids (not shown) as a sheet is advanced to nip 95 of rollers 96. A sheet and an image traveling on registration transport 59 and photoreceptor 40, respectively, are registered at transfer station 46. (In an alternate embodiment, photoreceptor 40 is an intermediate belt onto which images are transferred before arriving at an image transfer station.) A registration controller 99 forming part of ESS 6, insures proper registration of the sheet and the image at the transfer station by determining the rate at which servo motor/encoder 98 drives rollers 96 using output from sensor switch 90 which also forms part of ESS 6. The speed of rollers 96 is set so that the lead edge of a sheet is aligned with the lead edge of a toner image on photoreceptor 40. Lead edge sensor 80 detects the lead edge of a sheet during a first or simplex pass of a sheet.

After a first pass through transfer station 46, a sheet is inverted at duplex inverter 56 so that what was the lead edge of a sheet is subsequently the trail edge of the sheet. After a duplex sheet is moved onto registration transport 59 by vertical transport 57, one of four trail edge sensors 82, 83, 84, or 85 detect the trail edge of the sheet traveling thereon. Using the output from one of the four trail edge sensors 82, 83, 84, and 85, registration controller 99 determines a speed at which motor 98 needs to drive rollers 96 to align the backside of the sheet with a second toner image traveling on photoreceptor 40. The controller 99 registers the front and the back images on the photoreceptor 40 with a common edge of a sheet. Same or common edge registration insures that a front image is coincident with a back image on a single sheet of paper. Registration error between the front and back image are minimized because offset between the size of the front and the back images and the size of a sheet of paper are propagated towards a common edge.

Figure 3:
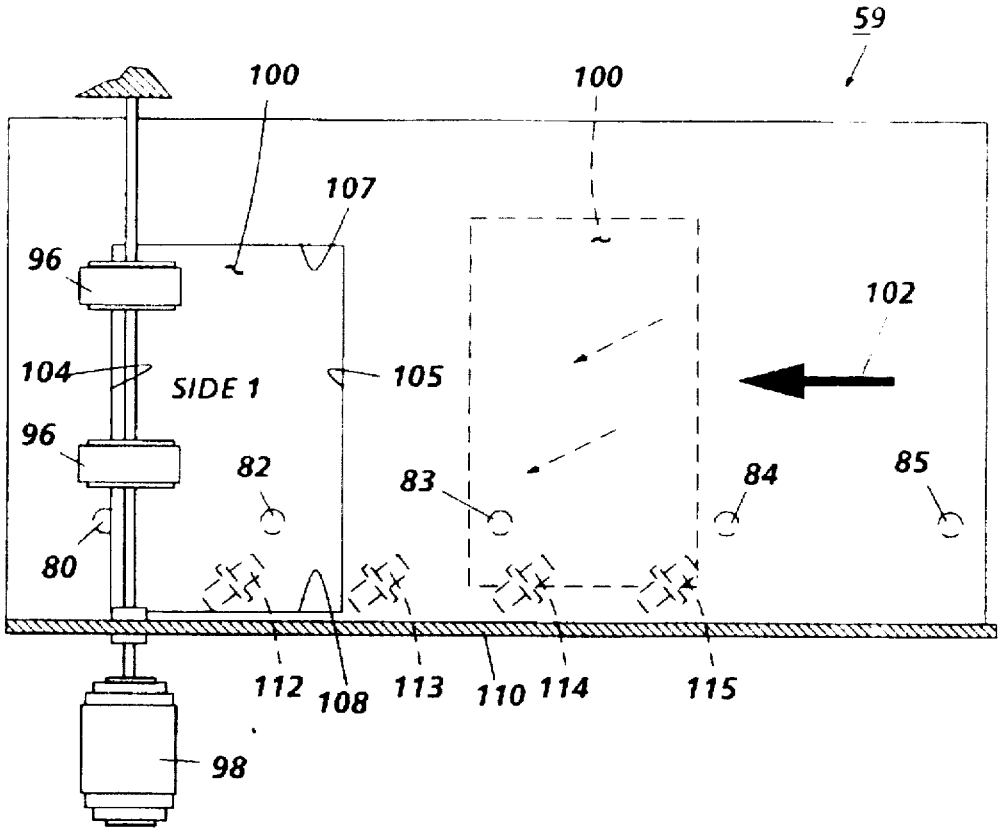
FIG. 3 is a plan view of a mechanical edge registration transport with a first side of a sheet being registered thereon.
Figure 4:
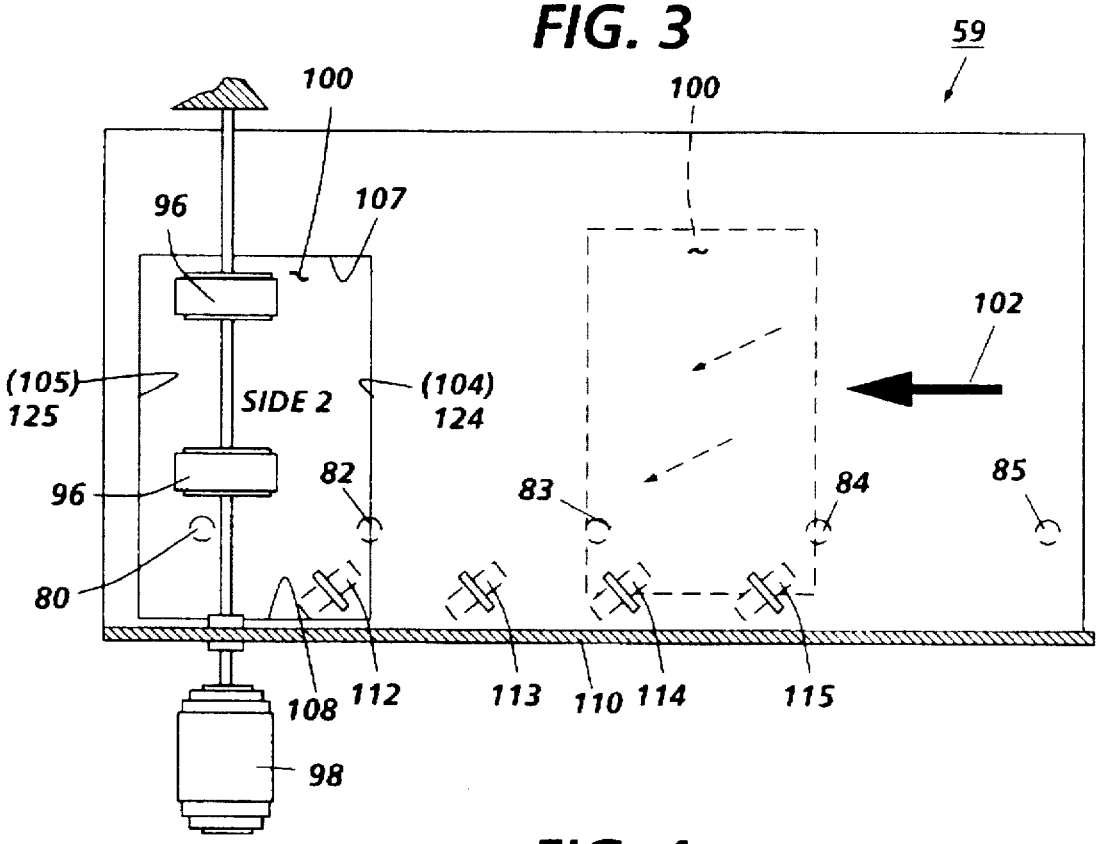
FIG. 4 is a plan view of the registration transport of FIG. 3 with a second side of the sheet being registered thereon.

With reference now to FIGS. 3 and 4, a top view of a mechanical edge registration transport 59 is shown in detail. A sheet 100 travels along transport 59 in a process direction depicted by arrow 102. Lead edge 104 and trail edge 105 advance perpendicular to the process direction 102. In-bound edge 107 and out-bound edge 108 move parallel to the process direction 102. FIG. 3 shows side registration of sheet 100 along registration edge 110. Cross rolls 112–115 exert a force on sheet 100 at a preset angle. The force exerted by cross rolls 112–115 pushes out-bound edge 108 of sheet 100 against registration edge 110 to orient inbound and out-bound edges 107 and 108 of sheet 100 parallel to the process direction. Side registration along a registration edge is well known as exemplified by U.S. Pat. No. 4,416,534, the pertinent portions of which are incorporated by reference. Once a sheet is side registered, that is registered along its in-bound and out-bound edges, the sheet is then registered with an image traveling on photoreceptor 40 at image transfer station 46.

With reference now to FIGS. 2 and 3, the lead edge sensor 80 detects lead edge 104 of sheet 100 during a first or simplex pass. When a sheet travels on transport 59 on its front side or simplex side, plex input 73 switches sensor switch 90 to direct sensory input from lead edge sensor 80 to registration controller 99. In addition, registration controller 99 receives input signals from servo motor/encoder 98, machine clock encoder 45, registration synch 71, sheet size 72, and sheet plex 73. Signal feedback from servo motor/encoder 98 provides information representing the speed at which servo motor 98 is driving registration rollers 96. Machine clock encoder 45 specifies the present speed of the photoreceptor 40. Registration synch 71 provides a signal when an image is scanned on the photoreceptor 40 and is at a known distance from transfer station 46. Control logic (not shown) in registration controller 99 then adjusts the speed of motor 98 so that the lead edge 104 of sheet 100 meets the lead edge of a toner image traveling on photoreceptor 40 (not shown). The lead edge of a toner image on photoreceptor 40 is the leading edge of the image moving perpendicular to a process direction. Examples of control logic used in registration controller 99 are disclosed in U.S. Pat. Nos. 4,416,534 and 4,519,700, the pertinent portions of which are incorporated herein by reference.

With reference now to FIG. 4, the sheet 100 is shown traveling on registration transport 59 after being inverted onto its backside or duplex side. What was lead edge 104 in FIG. 3 is now trail edge 124 in FIG. 4 and similarly trail edge 105 in FIG. 3 is now lead edge 125 in FIG. 4. In-bound edge 107 and out-bound edge 108 continue to move parallel to the process direction 102 and are the same for the simplex side (side 1) as well as the duplex side (side 2) of a sheet. Similar to the process used to register the simplex side of sheet 100, registration transport 59 registers the duplex side of sheet 100 along registration edge 110. However, a duplex signal from plex input 73 and a sheet size signal from sheet input 72 switches sensor switch 90 to select from trail edge sensors 82, 83, 84, or 85 for output to registration controller 99. Both plex input 73 and sheet size input 72 are programmed and stored in memory of ESS 6. With reference to FIGS. 2 and 4, the sheet size input 72 and the plex input 73 in combination set sensor switch 90 so that output from trail edge sensor 82 is input to registration controller 99.

Similar to simplex sheet registration, duplex sheet registration is performed by registration controller 99 which adjusts the speed of motor 98 so that the a second image traveling on photoreceptor 40 is properly registered with the duplex side (side 2) of sheet 100. However, unlike the simplex pass, during a duplex pass the registration controller 99 determines the speed at which to drive rollers 96 using the position of the trail edge of a sheet relative to the transfer station 46. Specifically, servo motor/encoder 98 drives rollers 96 at a speed set by registration controller 99 so that sheet 100 is aligned with a second toner image traveling on photoreceptor 40. Registration controller 99, which is given the distance between lead edge sensor 80 and each trail edge sensors 82–85, bases its speed calculation on the position of the trail edge 124 of sheet 100 relative to the sheet's virtual lead edge. A virtual lead edge of a sheet is the position of the trail edge of the sheet on its duplex side relative to its distance from its specified sheet size width. Plex input 73 and sheet input 72 direct registration controller 99 to select a speed at which rollers 96 must be driven so that front and back images on sheet 100 are registered with each other. Depending on the values of sheet size 72 and plex input 73, controller 99 accesses a speed for rollers 96 from a look-up table which is stored in a memory of ESS 6.

In accordance with the present invention, the speed at which motor 98 drives rollers 96 is determined using a sheet's lead edge on a simplex pass and a sheet's trail edge on a duplex pass. Consequently, a first and a second image are positioned on front and back of a single sheet after two passes through a transfer station and a fuser station so that they are coincident with each other on the single sheet. The present invention aligns the images with a common physical edge of a sheet by using a sheet's lead edge on a simplex pass and a sheet's trail edge on a duplex pass. A common edge of a sheet is used by a controller to determine the location of the sheet relative to a toner image arriving at the transfer station.

Figure 5:
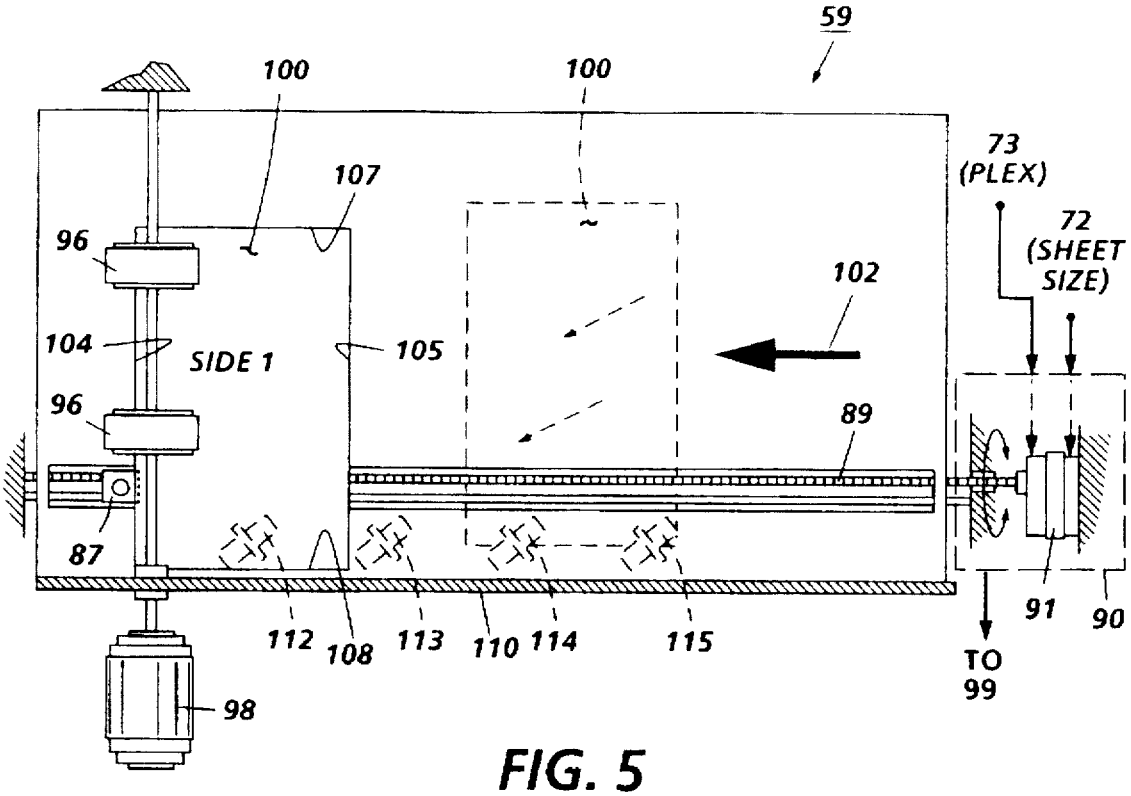
FIG. 5 is the plan view of a mechanical edge registration transport shown in FIG. 3 with an edge sensor mounted on a movable carriage.
Figure 6:
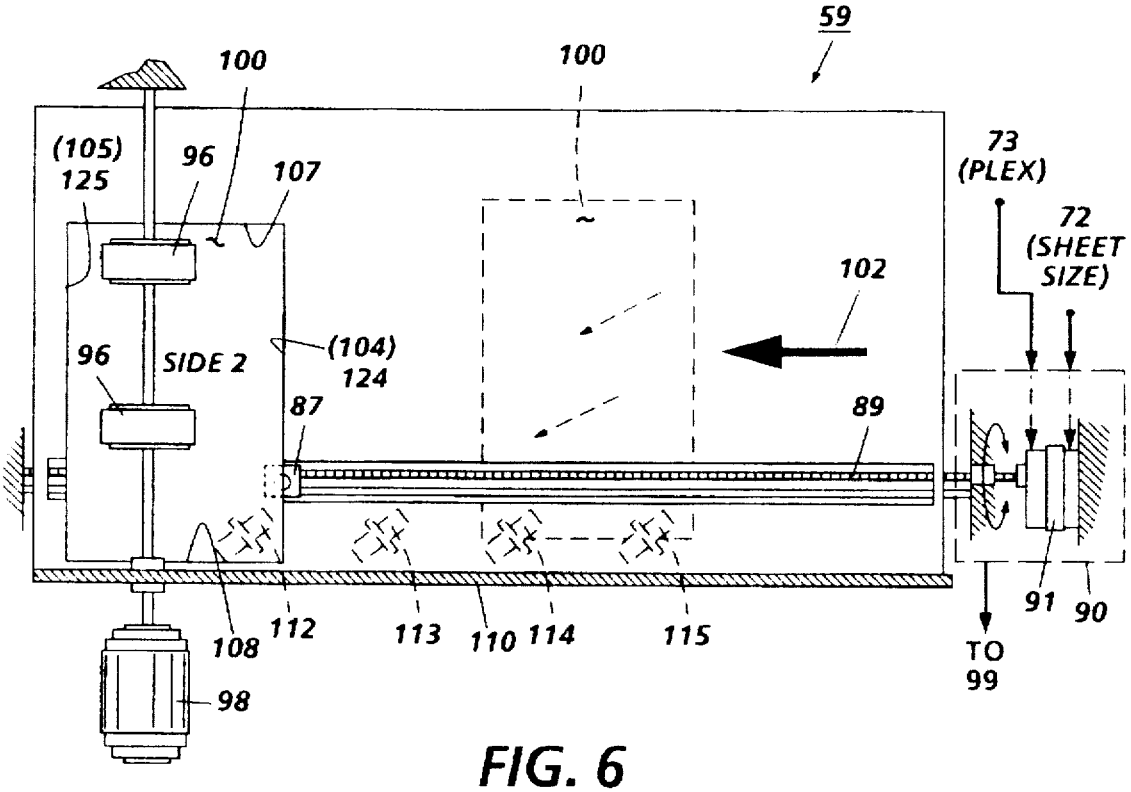
FIG. 6 is the plan view of a mechanical edge registration transport shown in FIG. 4 with an edge sensor mounted on a movable carriage.
Figure 7:
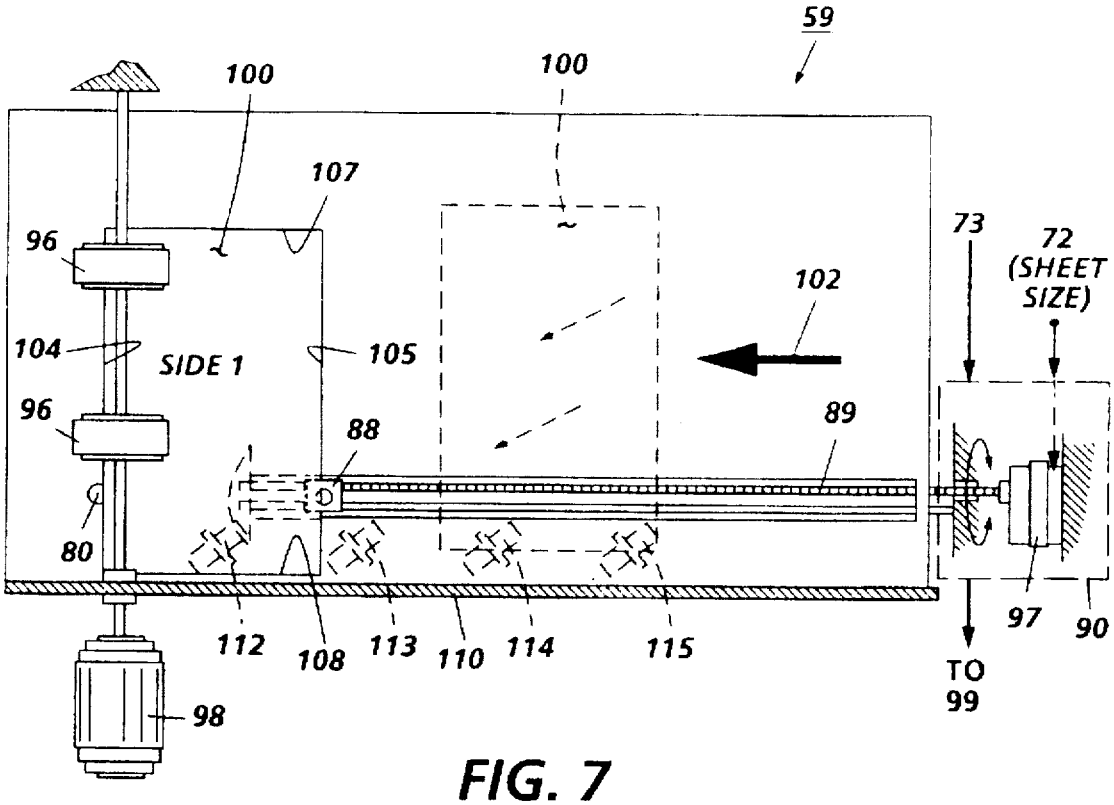
FIG. 7 is the plan view of a mechanical edge registration transport shown in FIGS. 4 and 6 with a trail edge sensor mounted on a movable carriage.

With reference now to an alternate embodiment of the mechanical edge registration system shown in FIGS. 3 and 4, FIGS. 5 and 6 show the lead edge of a first side and the trail edge of a second side of a sheet being detected by single sensor 87, respectively. In place of fixed sensors 80 and 82–85 shown in FIGS. 3 and 4, sensor 87 is mounted on movable carriage 89. Motor/controller 91 which forms part of sensor switch 90 controls the position of sensor 87 along carriage 89. Sheet size input 72 and plex input 73 actuate motor/controller 91 to move sensor 87 to a predetermined position along registration transport 59. In FIG. 5, sensor 87 is located in a position along carriage 89 that corresponds to sensor 80 shown in FIG. 3. Similarly in FIG. 6, sensor 87 is located in a position that corresponds to the position of sensor 82 shown in FIG. 4. When detecting a first side of a sheet, plex input 73 actuates motor/controller 91 to position sensor 87 to measure the lead edge of the sheet, and when detecting a second side of a sheet plex input 73 and sheet size input 72 actuate motor/controller 91 to position sensor 87 to measure the trail edge of a sheet. As discussed above for the edgeless registration transport shown in FIGS. 3 and 4, the position of sheet 100 that is detected by sensor 87 is output to registration controller 99 to determine the rate at which sheet 100 is advanced to be in timed registration with an image arriving at the image transfer station 86 shown in FIG. 2. With reference now to FIG. 7, an alternate embodiment combines the mechanical edge registration system shown in FIGS. 3 and 5. The lead edge sensor 80 that is shown in FIG. 3 continues to detect the lead edge of a sheet passing along transport 59. However, trail edge sensor 88 mounted on movable carriage 89 replaces trail edge sensors 82–85 shown in FIG. 4. Unlike motor/controller 91, sheet size input 72 actuates motor/controller 97 in sensor switch 90 to position only to one a predetermined trail edge position. Sheet 100 is then advanced at a rate set by registration controller 99 as discussed above.

Figure 8:
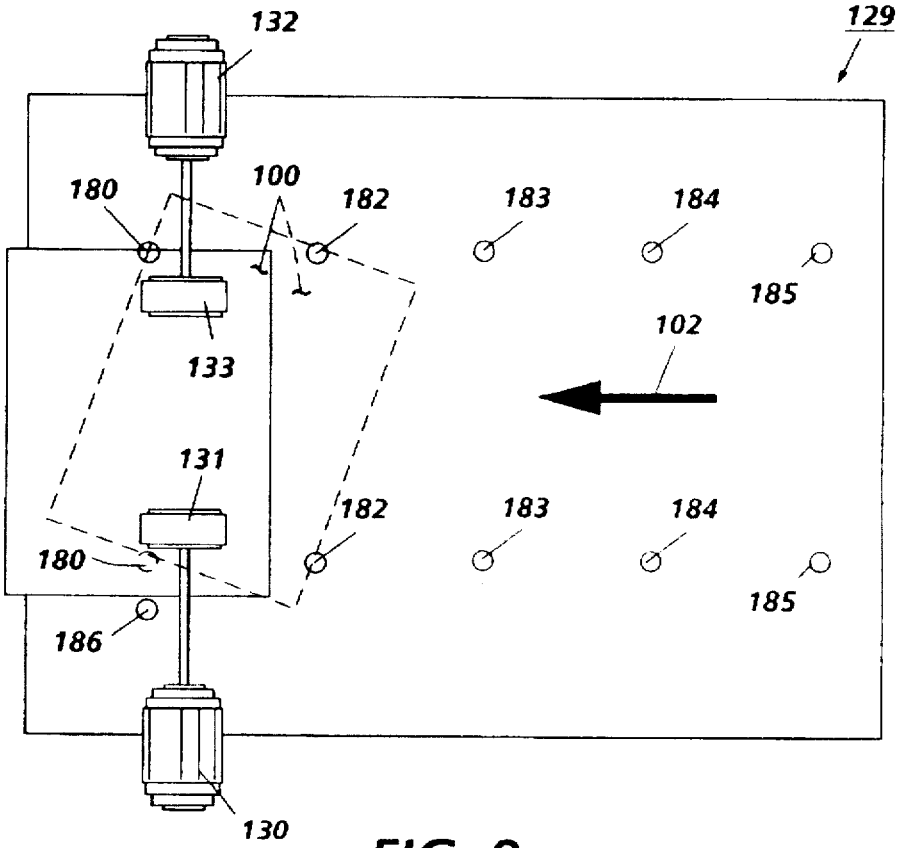
FIG. 8 is a plan view of an edgeless registration transport.

With reference now to FIG. 8 which shows an alternate embodiment of the present invention, an edgeless registration transport 129 includes sheet drive rolls 131 and 133 which are driven independently by two differential drive servo motor encoders 130 and 132, respectively. Edgeless registration systems are well known and disclosed in U.S. Pat. Nos. 4,971,304; 5,078,384; 5,094,442; 5,169,140; and 5,278,624, the pertinent portions of which are incorporated herein by reference. Edgeless registration transport 129 detects the skew and relative position of a sheet from photoreceptor 40 (shown in FIG. 2) using a pair of lead edge sensors 180 and a side edge sensor 186. When processing the first side or simplex side of sheet 100, the pair of sensors 180 detect the lead edge of sheet 100 in a similar manner to the embodiment shown in FIGS. 3 and 4. The pair of lead edge sensors 180 provide skew information to registration controller 99 (shown in FIG. 2) which controls differential motors 130 and 132. Motors 130 and 132 drive a pair of rolls 131 and 132, respectively, so that the lead edge of sheet 100 traveling in process direction 102 meets the lead edge of a toner image (not shown) traveling along photoreceptor 40 to image transfer station 46 (shown in FIG. 2).

In the case of processing the second or duplex side of a sheet, trail edge sensors 182–185 utilize the same method for deskewing a sheet as the lead edge sensors 180. However, as with the embodiment shown in FIG. 4, adjustments are made to the rate of drive rolls 131 and 132 based on the position of a sheet relative to its distance from the transfer station 46 (shown in FIG. 2). The location of lead edge sensors relative to trail edge sensors is learned by registration controller 99 during machine set-up so that high precision components and assembly techniques are minimized. Multiple pairs of trail edge sensors may be added if a significant range of sheet widths are available in the printing system. As a general rule, trail edge sensors should be positioned at a distance less than the size of a sheet away from drive rolls 96. For example, the position of sensors 182 may be at 8" for an 8.5" sheet.

Figure 9:
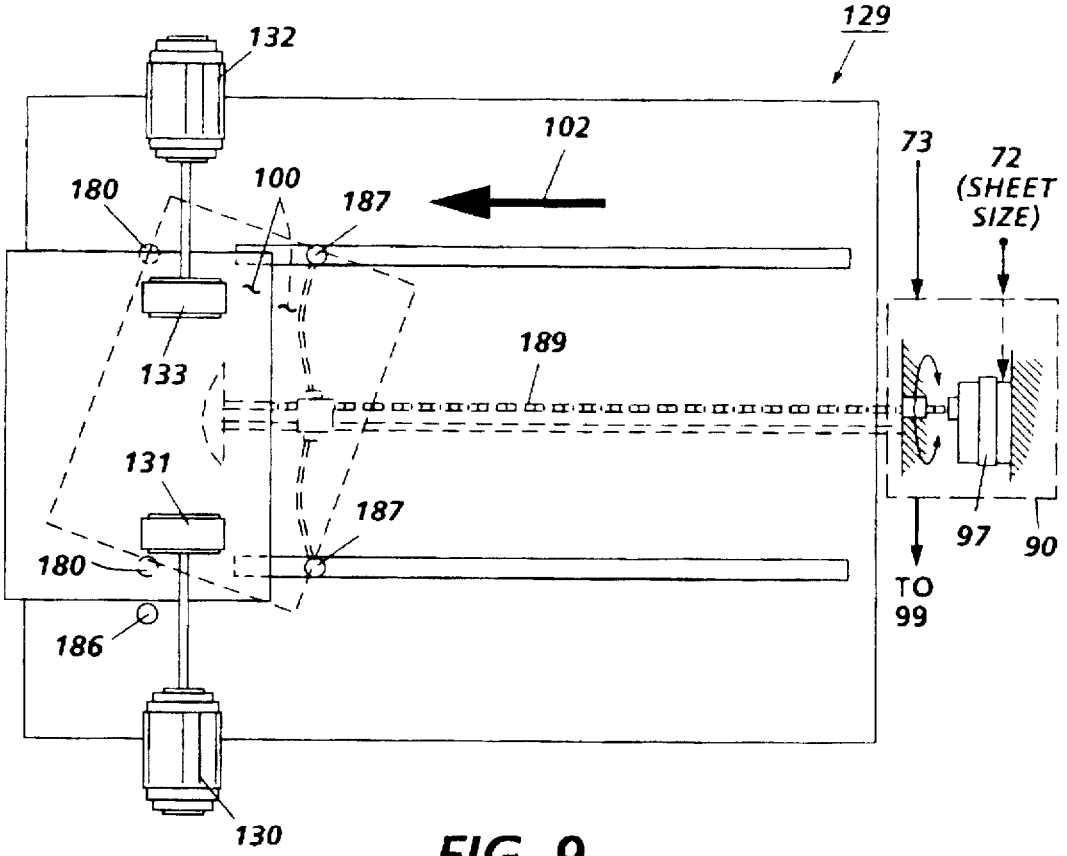
FIG. 9 is a plan view of an edgeless registration transport with trail edge sensors mounted on a movable carriage.
Figure 10:
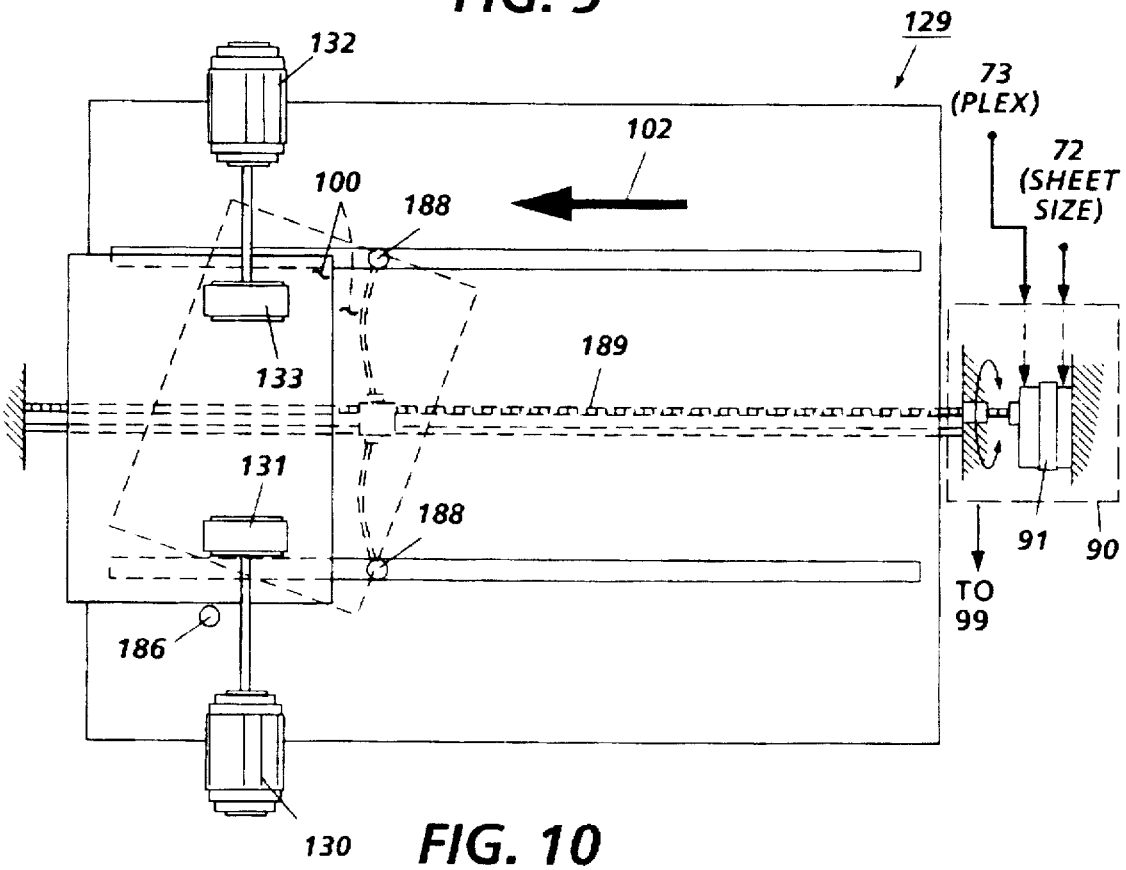
FIG. 10 is a plan view of an edgeless registration transport with edge sensors mounted on a movable carriage.

With reference now to FIG. 9 which shows another embodiment of the present invention, FIG. 9 shows an edgeless registration transport 129. Unlike the registration transport shown in FIG. 8 which has a plurality of pairs of trail edge sensors, the registration transport 129 shown in FIG. 9 has one pair of trail edge sensors 187 which are mounted on a movable carriage 189. The movable carriage 189 is positioned along the registration transport 129 to accommodate variations in sheet size width. Sheet size input 72 actuates motor/controller 97 of movable carriage 189 to a predetermined position along registration transport 129. Once carriage 189 is in position, a front image and a back image are registered on sheet 100 in a similar manner as that described for the embodiment shown in FIG. 8.

In an alternate embodiment, single sensor pair 188 is mounted on movable carriage 189. Similar to the mechanical edge registration transport 59 shown in FIGS. 5 and 6, sensor pair 188 is positioned along registration transport by motor/controller 91. Once in position, sensor pair 56 senses the lead or trail edge of sheet 100 for registration with an image at a transfer station as discussed above.

In summary, the present invention uses a common physical edge of a sheet during image registration by using the lead edge of a sheet on its simplex pass and the trail edge of a sheet on its duplex pass when calculating a sheet's distance from a toner image transfer station. Alternatively, the advantages of the present invention could be realized by using a trail edge sensor to detect the trail edge of a simplex sheet and a lead edge sensor to detect the lead edge of a duplex sheet. Regardless, common edge registration reduces the occurrence of registration errors due to variances in sheet size. For example, while machine paper tolerances may be ±0.65 mm, sheet cutting tolerances may be ±2.0 mm. Thus, using a common edge of a sheet to register an image in a two pass duplex system avoids up to 1.35 mm of offset between the front and back images.

Figure 11:
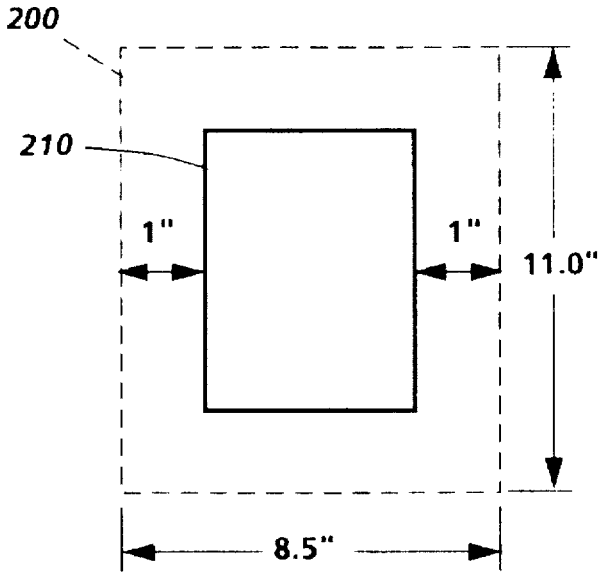
FIG. 11 is an illustrative example of an image traveling on a photoconductive belt before transfer to a sheet at an image transfer station.
Figure 12:
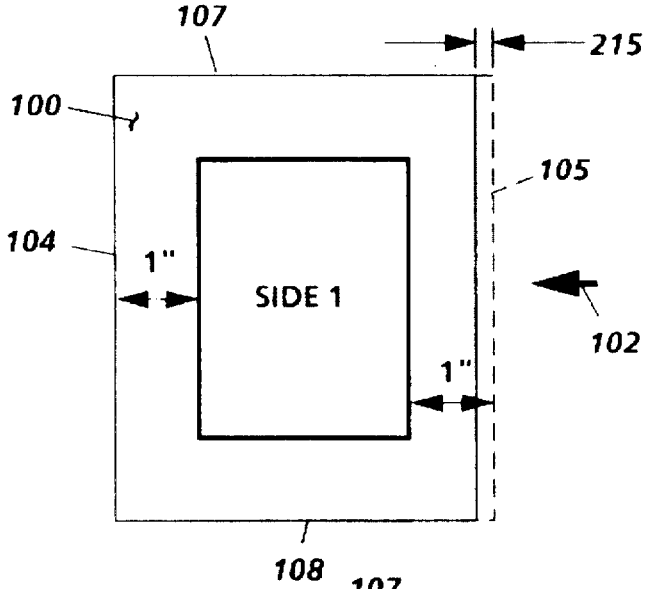
FIG. 12 is an illustrative example of the first side of a sheet traveling in a process direction after receiving the image shown in FIG. 11.
Figure 13:
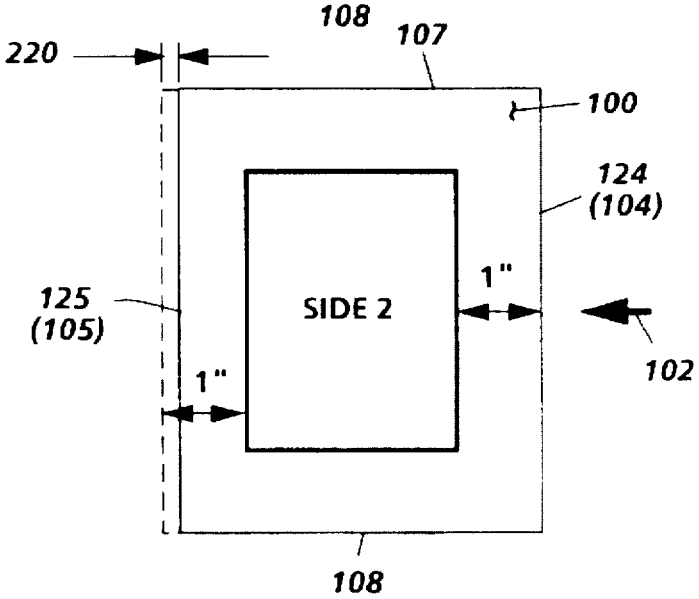
FIG. 13 is an illustrative example of the second side of the sheet shown in FIG. 12 after receiving the image shown in FIG. 11.

With reference now to FIGS. 11–13, FIG. 11 represents a toner image 200 traveling on a photoreceptor towards a transfer station. The toner image 200 has dimensions 8.5"× 11" includes imagable object 210. The imagable object 210 is a rectangle with dimensions 6.5"×9" and located in the center of the 8.5"×11" toner image 200. Assume that toner image 200 is in duplicate and is imaged on both the front and back of sheet 100 shown in FIGS. 12 and 13. FIG. 12 represents sheet 100 traveling in process direction 102 with the rectangle 210 transferred and fused thereon. However, sheet 100 does not have exactly the dimensions of 8.5"×11", and because of imprecise sheet cut tolerances the width of sheet 100 is 1.0 mm shorter than 8.5". The 1.0 mm variance results in image offset 215 at the trail edge 105, on the front side or simplex side of sheet 100. FIG. 13 represents the duplex side of sheet 100, traveling in process direction 102, with toner image 200 imaged thereon using a common edge or trail edge 124, in accordance with the present invention. After imaging and fusing, sheet cut tolerance offset 220 is shifted to the lead edge 125 of the back or duplex side of sheet 100. Thus, common edge registration shifts image offset 215 and 220 to a common edge 105 (125) of sheet 100, thereby eliminating image registration due to sheet cut tolerances.

It will no doubt be appreciated that common edge registration can be accomplished using a variety of image registration devices. What is required by this invention is that a two- pass duplex printing system register front and back images using a common physical edge of a sheet. Specifically in a multi-pass printing system, upon inversion of a sheet a trail edge sensor is used instead of a lead edge sensor so that a common physical edge of the sheet is used by a printing system to control the registration of an image traveling on a photoreceptor, at an image transfer station, with a sheet of paper traveling on a registration transport. The present invention could be accomplished by replacing the lead edge sensor and the trail edge sensors with a sensor bar, or an array of closely spaced sensors. It will also no doubt be appreciated that the present invention is not limited to printing systems having a single photoreceptor belt. Specifically, the present invention can be used with tandem tri-level printer architectures which transfer images to an intermediate belt before transfer to a copy sheet.

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

What is claimed is:

1. An apparatus for registering a first image printed on a first side of a sheet and a second image printed on a second side of the sheet with one another at a transfer station, comprising:

a transport for moving the sheet to the transfer station, said transport moving the first side of the sheet to the transfer station to have the first image printed thereon; means for inverting the sheet to move the second side of the sheet to the transfer station to have the second image printed thereon;

a first sensor for detecting a first edge of the sheet before printing the first image on the first side of the sheet;

a second sensor for detecting the first edge of the sheet after printing the first image on the first side of the sheet and before printing the second image on the second side of the sheet, with the sheet being inverted after printing the first image on the first side of the sheet so that the first edge is a leading edge of the sheet in a direction of movement of the sheet before inverting the sheet and a trailing edge of the sheet after inverting the sheet in the direction of movement of the sheet; and a controller, responsive to the said first sensor and said second sensor, for regulating said transport so as to position the sheet at the transfer station to print the first image on the first side of the sheet and the second image on the second side of the sheet in registration with one another.

2. An apparatus according to claim 1, further including means for moving said sensor to a first position to detect the first edge and to a second position to detect the second edge.

3. An apparatus according to claim 1, further comprising means for inverting the sheet after the transfer station prints the first image on the first side of the sheet.

4. An apparatus according to claim 1, wherein said transport comprises a registration edge for registering a sheet thereon.

5. An apparatus according to claim 1, further comprising a moving belt for transporting the first image and the second image to the transfer station.

6. An apparatus according to claim 5, further comprising an encoder, associated with said belt, measuring said belt speed.

7. An apparatus according to claim 5, further comprising means for generating a registration signal to indicate when an image is formed on said belt.

8. A method for registering a first image printed on a first side of a sheet and a second image printed on a second side of the sheet with one another at a transfer station, comprising:

transporting the first side of the sheet to the transfer station to print the first image thereon;

inverting the sheet;

moving the sheet to the transfer station after said step of inverting to print the second image on the second side of the sheet at the transfer station;

detecting a first edge of the sheet with a first sensor before printing the first image on the first side of the sheet;

detecting the first edge of the sheet with a second sensor after printing the first image on the first side of the sheet and before printing the second image on the second side of the sheet, with the sheet being inverted and printing the first image on the first side of the sheet so that a first edge is a leading edge of the sheet in a direction of movement of the sheet before said step of inverting the sheet and the trailing edge of the sheet after said step of inverting the sheet; and regulating the transport with a controller so as to position the sheet at the transfer station to print the first image on the first side of the sheet and the second image on the second side of the sheet in registration with one another.

9. A method according to claim 8, further comprising the step of moving the sensor to a first position to detect the first edge and to a second position to detect the second edge.

10. A method according to claim 8, further comprising the step of inverting the sheet after the transfer station prints the first image on the first side of the sheet.

11. A method according to claim 8, further comprising the step of transporting the first image and the second image to the transfer station on a moving belt.

12. A method according to claim 11, further comprising the step of measuring the belt speed.

13. A method according to claim 11, further comprising the step of generating a registration signal to indicate when an image is formed on the belt.

14. A method according to claim 8, further comprising the step of detecting when an image is a predetermined distance from the image transfer station.

15. A method according to claim 8, further comprising the step of registering the sheet on the transport with a registration edge.

* * * * *